US006584894B1

(12) United States Patent
Mason

(10) Patent No.: US 6,584,894 B1
(45) Date of Patent: Jul. 1, 2003

(54) METHOD AND APPARATUS FOR MARKING ITEMS OF VARIED SHAPES

(75) Inventor: Christopher W. Mason, Mishawaka, IN (US)

(73) Assignee: Nibco, Inc., Elkhart, IN (US)

( * ) Notice: Subject to any disclaimer, the term of this patent is extended or adjusted under 35 U.S.C. 154(b) by 0 days.

(21) Appl. No.: 09/519,289

(22) Filed: Mar. 6, 2000

(51) Int. Cl.[7] ..... B41F 17/20
(52) U.S. Cl. ..... 101/35; 101/424.1
(58) Field of Search ..... 101/424.1, 35, 101/37, 40, 40.1, 43, 44

(56) References Cited

U.S. PATENT DOCUMENTS

| | | | | | |
|---|---|---|---|---|---|
| 3,274,927 | A | * | 9/1966 | Lusher et al. | 101/40 |
| 3,641,930 | A | | 2/1972 | Riddington | 101/35 |
| 3,786,746 | A | | 1/1974 | Roberts | 101/35 |
| 3,916,784 | A | | 11/1975 | Dubuit | 101/40 |
| 3,960,073 | A | | 6/1976 | Rush | 101/40 |
| 4,047,479 | A | | 9/1977 | McKay et al. | 101/36 |
| 4,060,031 | A | | 11/1977 | Philipp | 101/163 |
| 4,246,840 | A | * | 1/1981 | Yoshino et al. | 101/37 |
| 4,455,328 | A | * | 6/1984 | Jenkins | 118/47 |
| 4,473,008 | A | | 9/1984 | Heyman | 101/170 |
| 4,530,286 | A | | 7/1985 | Samuels | 101/395 |
| 4,566,382 | A | | 1/1986 | Bronson et al. | 101/35 |
| 4,593,616 | A | | 6/1986 | De Lorenzi | 101/163 |
| 4,682,182 | A | | 7/1987 | Oyama et al. | 101/35 |
| 4,709,632 | A | | 12/1987 | Samuels et al. | 101/163 |
| 4,738,199 | A | | 4/1988 | Chen | 101/163 |
| 4,813,351 | A | * | 3/1989 | Pierson, Jr. | 101/115 |
| 5,018,966 | A | | 5/1991 | Braun | 432/59 |
| 5,023,437 | A | | 6/1991 | Speicher | 400/121 |
| 5,056,429 | A | | 10/1991 | Hirosaki | 101/93.01 |
| 5,111,605 | A | | 5/1992 | Bossi | 40/316 |
| 5,207,153 | A | | 5/1993 | Thomason | 101/35 |
| 5,226,361 | A | | 7/1993 | Grant et al. | 101/44 |
| 5,239,613 | A | * | 8/1993 | Motev et al. | 101/115 |
| 5,383,398 | A | | 1/1995 | Binnen | 101/41 |
| 5,390,964 | A | | 2/1995 | Gray, Jr. | 285/93 |
| 5,423,252 | A | | 6/1995 | Yamamoto et al. | 101/35 |
| 5,489,126 | A | | 2/1996 | Gray, Jr. | 285/93 |
| 5,526,748 | A | * | 6/1996 | Schleinz et al. | 101/223 |
| 5,570,632 | A | | 11/1996 | Cumens et al. | 101/35 |
| 5,797,493 | A | | 8/1998 | Watson | 206/443 |
| 5,921,177 | A | * | 7/1999 | Shin | 101/41 |
| 6,079,326 | A | * | 6/2000 | Strutz et al. | 101/37 |
| 6,152,030 | A | * | 11/2000 | Fuqua | 101/115 |
| 6,176,181 | B1 | * | 1/2001 | Van Ryzin et al. | 101/178 |
| 6,228,169 | B1 | * | 5/2001 | Wallace | 118/308 |
| 2001/0042456 | A1 | * | 11/2001 | Kamen et al. | 101/38.1 |

FOREIGN PATENT DOCUMENTS

| | | | |
|---|---|---|---|
| GB | 1563834 A | * | 4/1980 |
| JP | 7-237400 A | * | 9/1995 |
| JP | 0803438868 | | 6/1996 |
| JP | 9-138833 A | * | 5/1997 |

* cited by examiner

*Primary Examiner*—Daniel J. Colilla
(74) *Attorney, Agent, or Firm*—Price Heneveld Cooper DeWitt & Litton

(57) ABSTRACT

A method is provided for marking items by orienting the items so that ink may be printed on the desired area of the items. The items are fed to a printing station and ink of a first color is printed on the items and then dried. The ink is then cured by providing heat to the ink. Also provided is an apparatus for marking differently-shaped items comprising a printing station having an ink printer and a dryer. The apparatus also has a curing tunnel for curing the ink onto the items.

3 Claims, 11 Drawing Sheets

METHOD AND APPARATUS FOR MARKING ITEMS OF VARIED SHAPES

BACKGROUND OF THE INVENTION

The present invention relates to the marking of items, and more particularly to methods and apparatus for marking of an ink UPC bar code on differently-shaped items.

It is common practice in most industries today to mark items that will be sold at a retail outlet with a UPC bar code. The UPC bar code allows for quick scanning of the price and other information about the product at the retail store. However, it has been traditionally very difficult to print a bar code on certain items due to their shape and/or composition. Therefore, such items either must be put in a bag, which has the UPC bar code thereon, or a sticker must be used with the UPC bar code thereon, which is first printed, then adhered to the item.

However, there are disadvantages to both of these methods. First, when the item is packaged in a bag and the bag has the UPC symbol thereon, an additional cost is added to the item by inclusion of the bag and the sales display of such an item may not be nearly as attractive as the item displayed without any packaging, especially packaging in bag form. Second, when a sticker is applied to the item itself, the sticker often has a tendency to become detached from the item during transportation of the item or while the item is on display and can be a fire hazard in some instances where the item will eventually be used in close contact with fire, such as a copper pipe fitting when a torch is used near it. Furthermore, the sticker can become worn during the transportation, rendering the UPC bar code unusable.

Methods have been used to attempt to apply and/or verify marks on various items and objects. These methods include that disclosed in U.S. Pat. No. 5,570,632 to Cumens et al. Cumens et al. disclose a process and device for applying and verifying marks on cylindrically-shaped objects. The products disclosed by Cumens et al. are cylindrical in nature and are transported through the process in a vertical position. Furthermore, the objects travel in a continuous, in-line motion during printing or marking. Such a design limits the applicability of the process to a particular shape of object and does not provide for drying, curing, or verification of the printing on the object.

U.S. Pat. No. 5,383,398 to Binnen discloses a process and device for pad printing multi-color images onto stationary objects. However, the Binnen device does not provide for curing, part handling, orientation, mark verification or other such desired operations.

The available devices and/or methods do not provide for a versatile marking system that can print multi-color markings on a variety of differently-shaped and oriented objects. Therefore, there is a desire and need in industry to have such a versatile apparatus and method that allows marking and/or printing on a variety of differently-shaped and oriented objects.

SUMMARY OF THE INVENTION

One aspect of the present invention is a method of marking an item by orienting the item so that ink may be printed on the desired area of the item. The item is fed to a printing station and ink of a first color is printed on the item and then dried. The ink is then cured by providing heat to the ink.

Another aspect of the present invention is an apparatus for marking differently-shaped items comprising a printing station having a pad printer, a dryer, and a gripper for removing the items from the printing station. The apparatus also comprises a curing tunnel for curing the ink on the items.

These and other features, advantages and objects of the present invention will be further understood and appreciated by those skilled in the art by reference to the following specification, claims and appended drawings.

DETAILED DESCRIPTION OF PREFERRED EMBODIMENT

Figure 1:
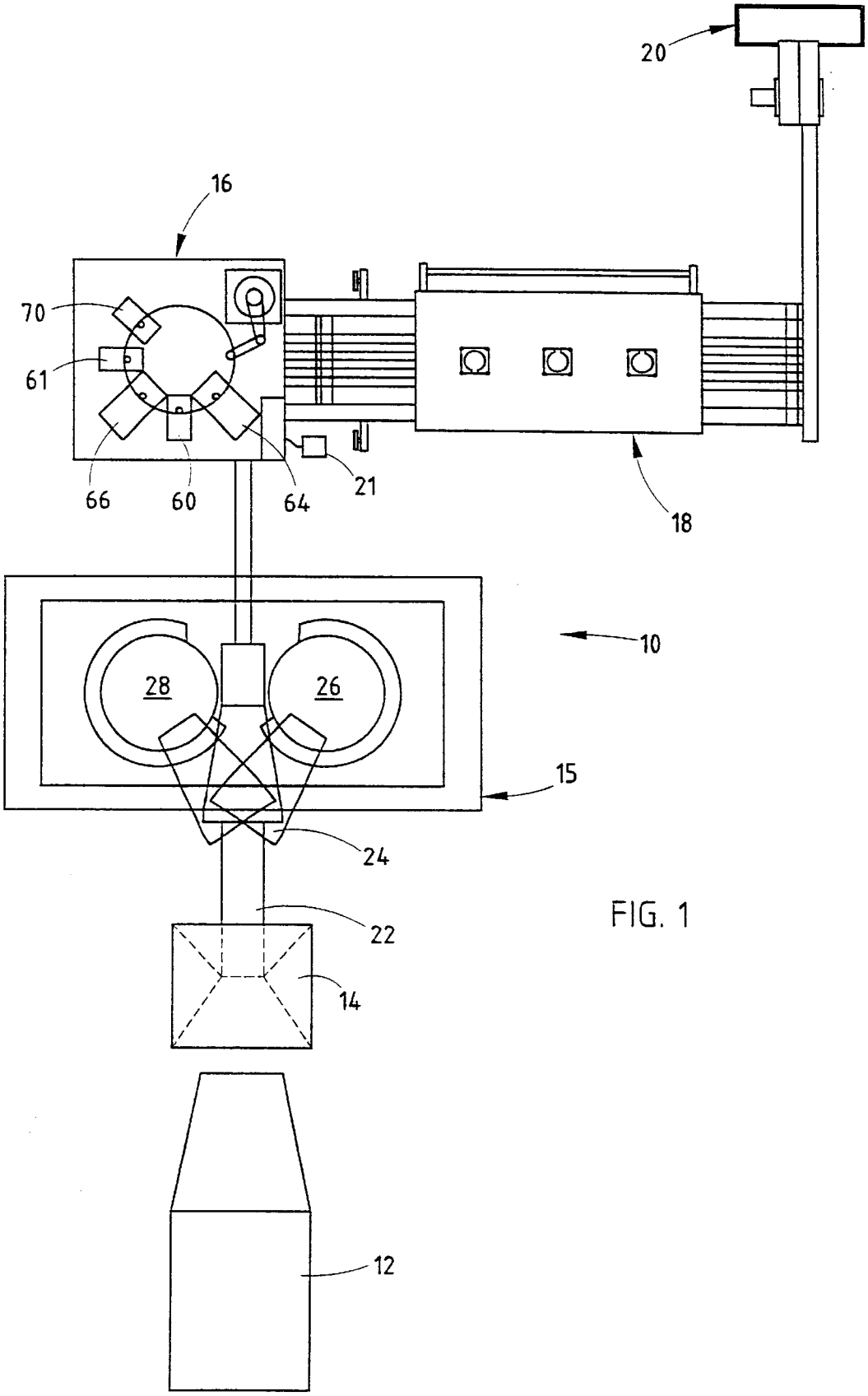
FIG. 1 is a plan view of the feeding, marking, and packaging apparatus of the present invention.

For purposes of description herein, the terms "upper," "lower," "right," "left," "rear," "front," "vertical," "horizontal," and derivatives thereof shall relate to the invention as oriented in FIG. 1, the top of the apparatus facing out from the printed page. However, it is to be understood that the invention may assume various alternative orientations, except where expressly specified to the contrary. It is also to be understood that the specific devices and processes illustrated in the attached drawings, and described in the following description, are simply exemplary embodiments of the inventive concepts defined in the appended claims. Hence, specific dimensions of other physical characteristics relating to the embodiments disclosed herein are not to be considered as limiting, unless the claims expressly state otherwise.

FIG. 1 generally shows the apparatus 10 for marking items, packaging said items in a carton, and conveying said items to a desired location. Generally, marking system 10 of the present invention includes a bulk product tilt station 12, an infeed hopper 14, a feeder 15, a printing station 16, a curing tunnel 18, and a fill station 20. The bulk product tilt station 12, infeed hopper 14, and feeder 15 create a part orientation and feeding portion of marking system 10. The marking system 10 is controlled by a master PLC 21, which controls the timing and sequence of the steps for feeding and marking the items.

The bulk product tilt station 12 receives the items to be printed in bulk, for example copper pipe fittings, and directs the items to the infeed hopper 14. Infeed hopper 14 in turn motivates the items onto a conveyor 22, which conveys the items to feeder 15. Feeder 15 includes a swivel chute 24, which directs the items into two bowl feeders 26 and 28.

Figure 2:
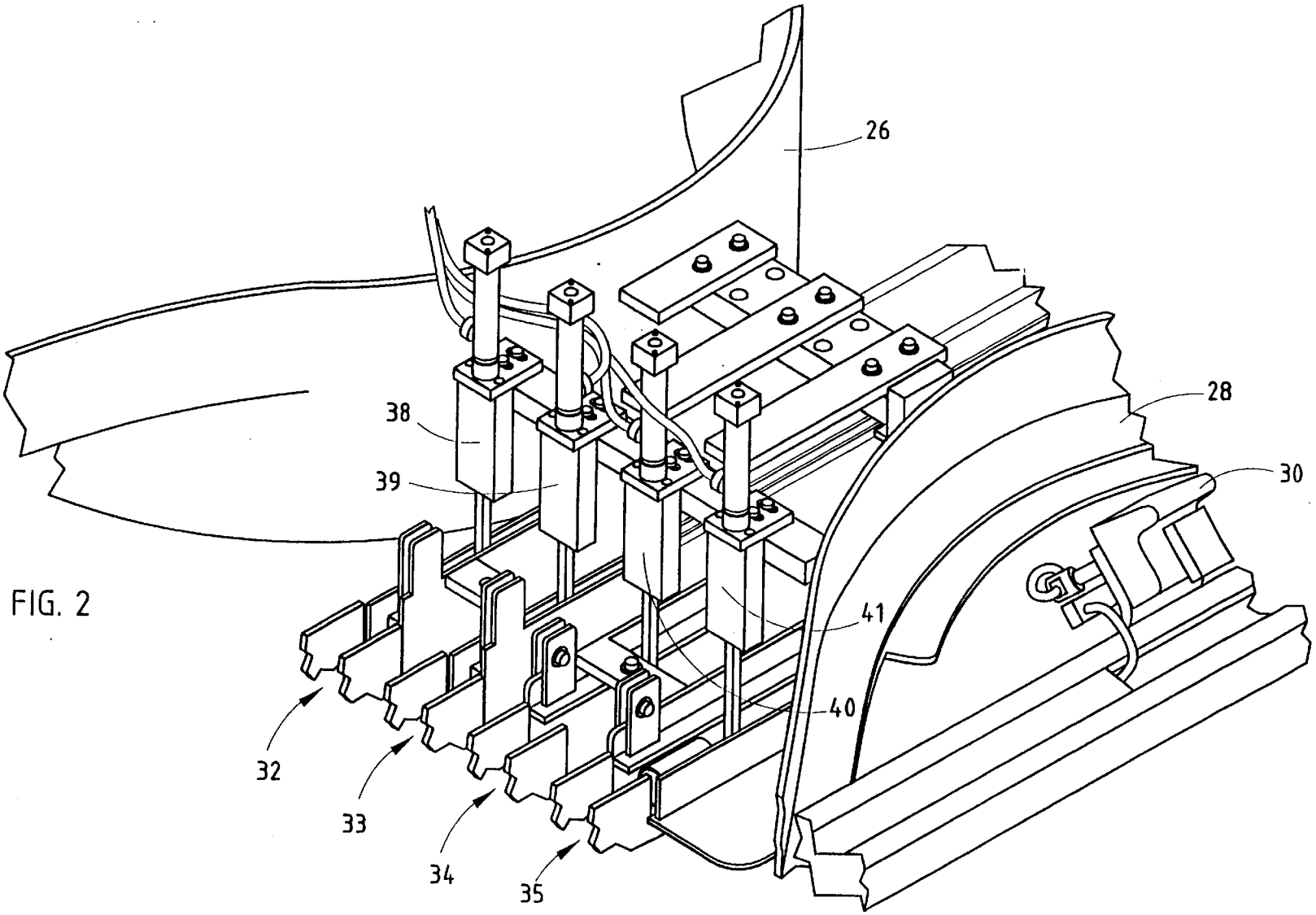
FIG. 2 is a perspective view of a bowl feeder and infeed conveyors of the apparatus shown in FIG. 1.

Bowl feeders 26 and 28 are each equipped with a low product sensor 30 that triggers the infeed hopper 14 to cycle and in turn causes the swivel chute to toggle (FIG. 2). Thus, sensor 30 insures that the bowl feeders are kept filled with product. Bowl feeders 26 and 28 are preferably stainless steel vibratory feeder bowls. The items are moved from bowl feeders 26 and 28 to four infeed conveyors 32, 33, 34, and 35. Bowl feeder 26 supplies infeed conveyors 32 and 33, while bowl feeder 28 supplies infeed conveyors 34 and 35. Infeed conveyors 32–35 are sized to contain the desired item to be marked. The feeder also includes four stack stoppers 38, 39, 40, and 41, which are made of a pneumatic cylinder construction, each having an 80 psi air line 44 connected thereto. Stack stoppers 38–41 hold back the stack or row of parts coming out of bowl feeders 26 and 28 to allow only one item at a time to enter into each of the infeed conveyors 32–35. The use of the stack stoppers minimizes jams and makes the entire operation more efficient. The items are conveyed from the feeder 15 to the printing station 16 by infeed conveyors 32–35.

Figure 3:
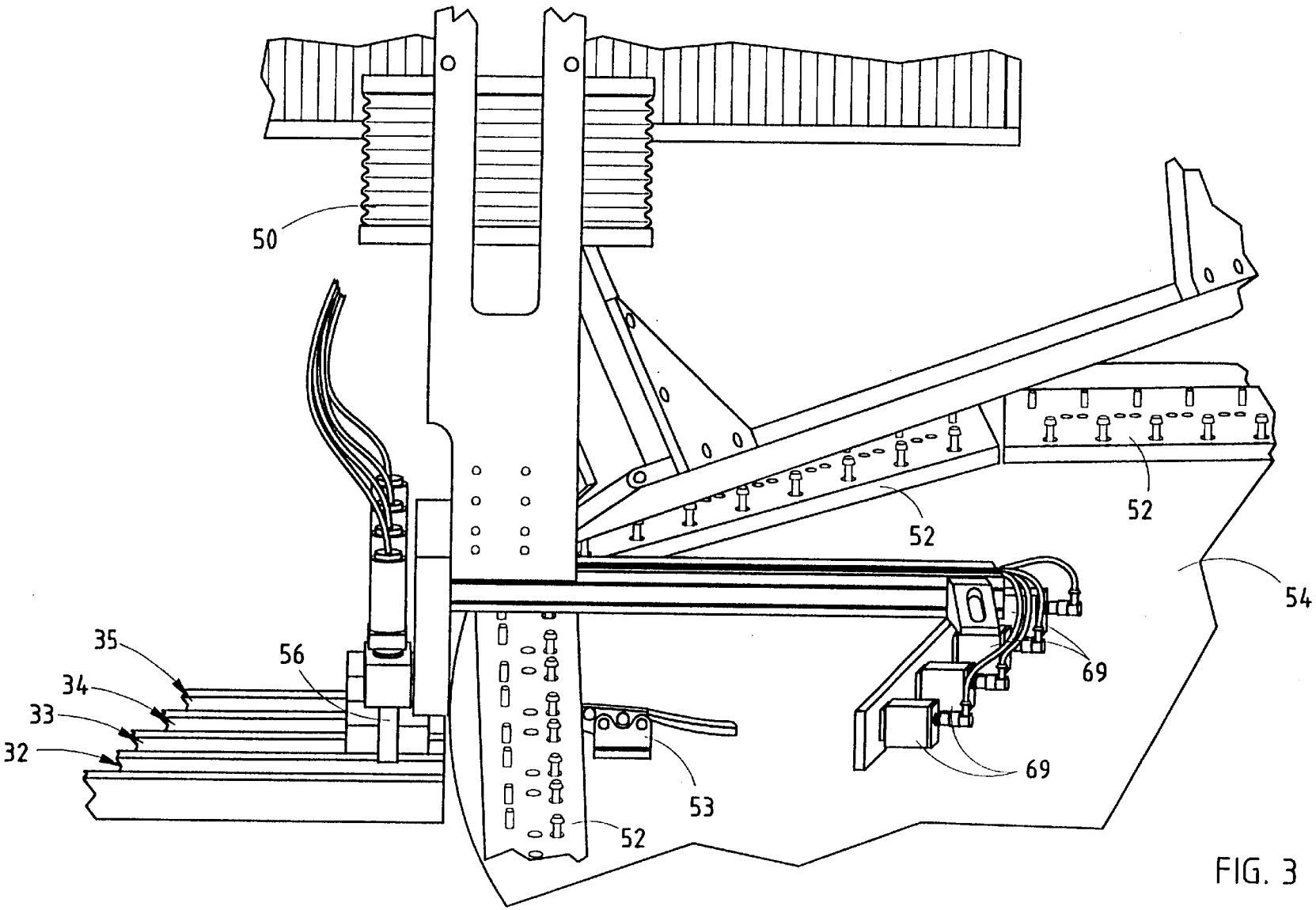
FIG. 3 is an elevational view of a pick-and-place unit and turntable of the apparatus shown in FIG. 1.

As seen in FIG. 3, printing station 16 includes a servo-controlled robot 50. Robot 50 includes grippers and rotators 56 that grip each item individually and rotate it to the desired orientation. Robot 50 grabs the four items from the infeed conveyors 32–35 and places each item onto a product fixture 52 on a printing station turntable 54. Preferably, the printing station has twelve product fixtures 52 and each holds four items. Turntable 54 likewise preferably includes twelve fixture hold down clamps 53 which hold the product fixtures 52 in place during the printing, drying, and verification processes. Turntable 54 is a rotary dial index table and travels in a clockwise direction when viewed from above. Also shown in FIG. 3 are four product sensors 69, which ensure that four items are properly seated in product fixtures 52 after servo robot 50 places the items in product fixture 52 and before the printing station 16 goes through its cycle of printing the desired logo, print, or code on the items. If the items are not seated properly in product fixture 52, sensors 69 trigger PLC 21 which shuts down the operation of the printing station 16 and sends an alarm to the operator.

Figure 4:
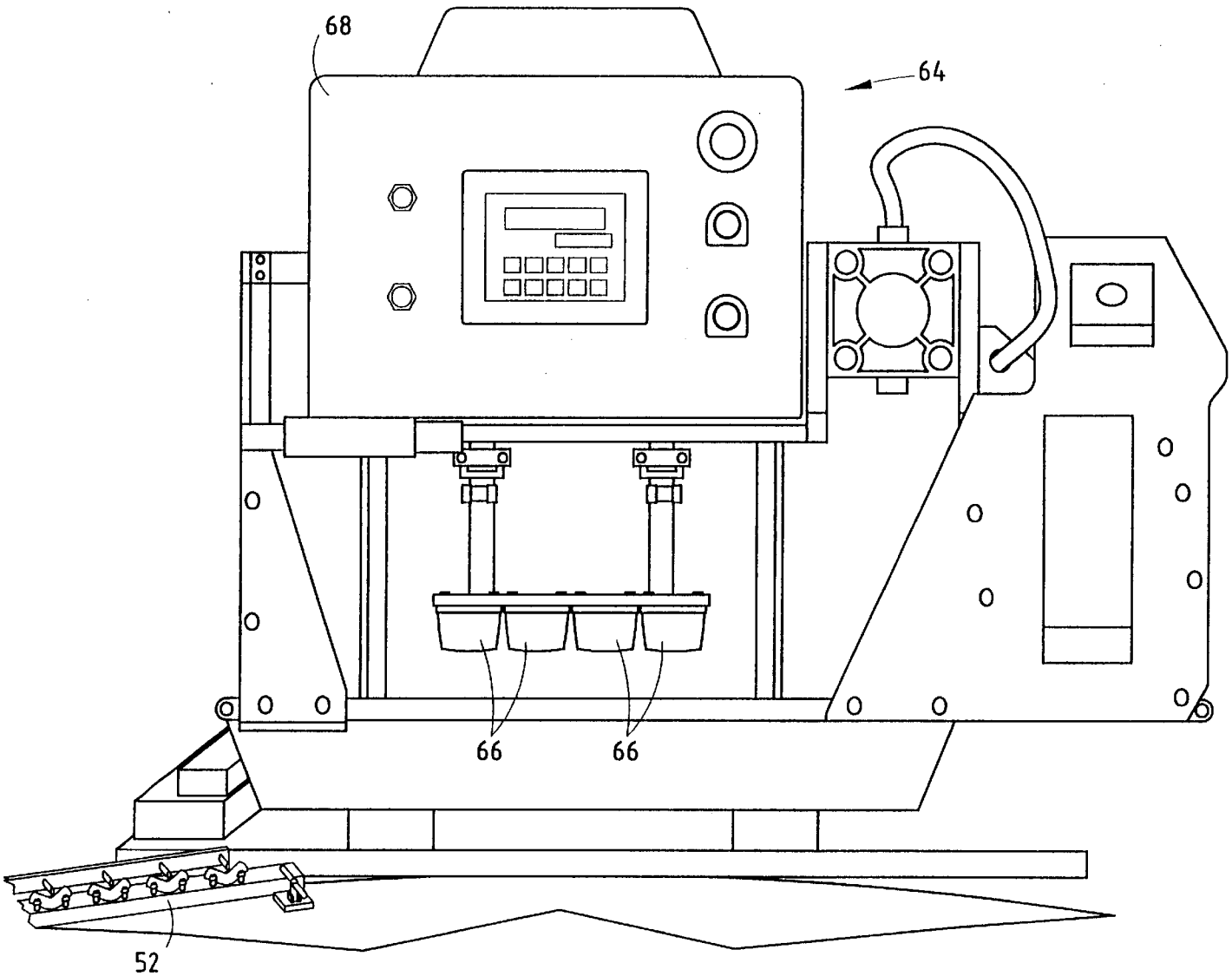
FIG. 4 is an elevational view of one pad printer of the printing station of the apparatus shown in FIG. 1.

FIG. 4 shows one of the two pad printers 64 of the printing station, the first of which is located clockwise to robot 50 when viewed from above. The pad printers 64 each have four printing pads 66 that lift ink off a cliche, described below, and transfer the ink to the item by pressing the pad downwardly onto the item held in product fixture 52. Preferably, each pad printer supplies a single color that is different from the color supplied by the other pad printer. The product printers 64 are controlled by a PLC 68, which is programmed to ensure the proper timing and sequence of the printing step and is separate from PLC 21.

Figure 5:
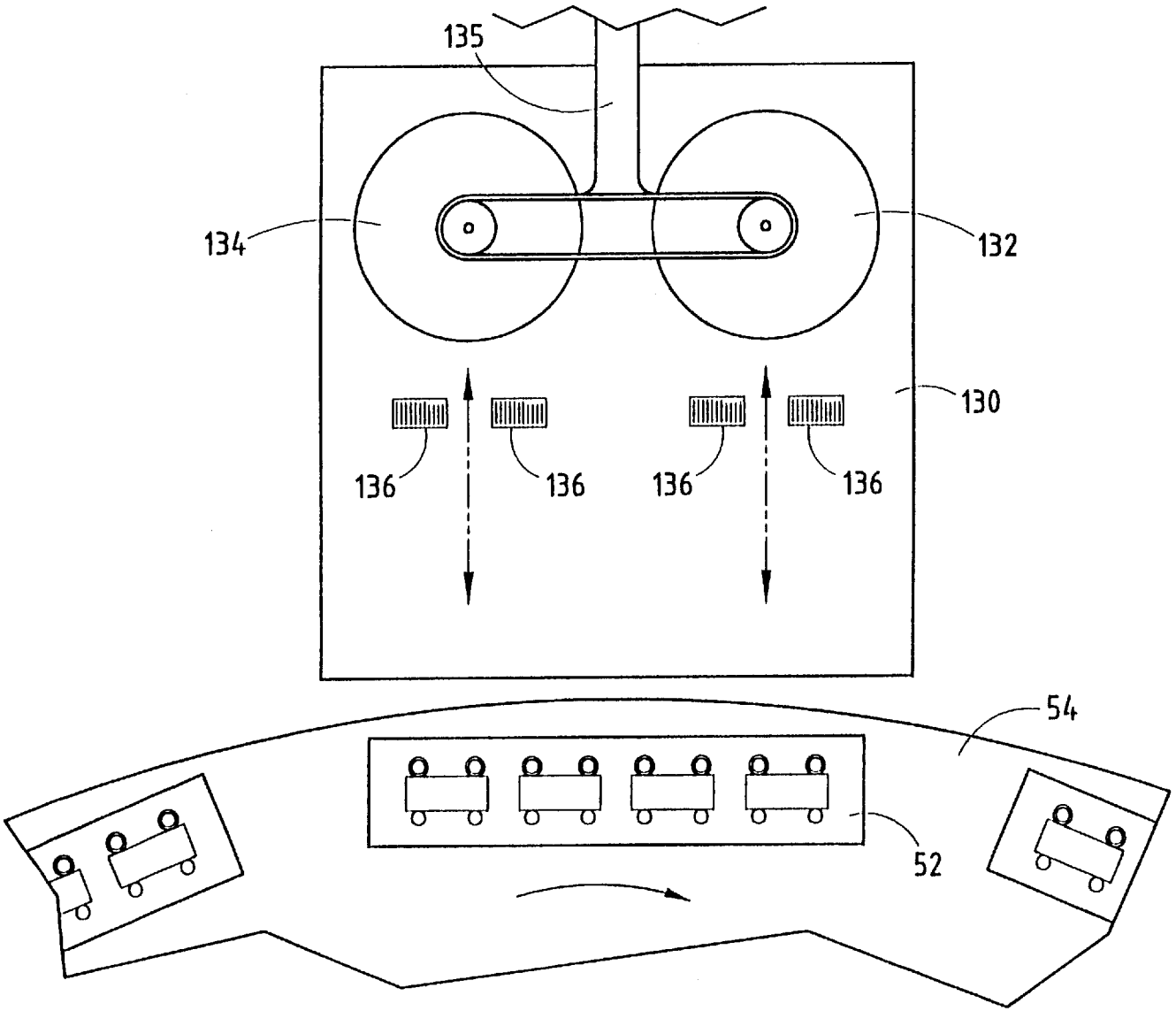
FIG. 5 is a top plan view of an ink cliche of the printing station of the apparatus shown in FIG. 1.

FIG. 5 shows the cliché 130 of the printing station. The printing station preferably has two clichés, one for each printing stage/color. The cliché includes two ink cups 132, 134, each of which transfer ink into two receptacles 136 by moving across the receptacles and scraping the ink off of the area surrounding the receptacles. Pad printers 64 also include a shaft 135 with an end that connects to ink cups 132, 134. Shaft 135 is motivated to initiate forward and rearward ink cup travel. Pads 66 are positioned so they can be lowered onto said receptacles, after the receptacles are filled with ink, to pick up the ink in the receptacles and transfer it to the item which is to be printed.

Figure 6:
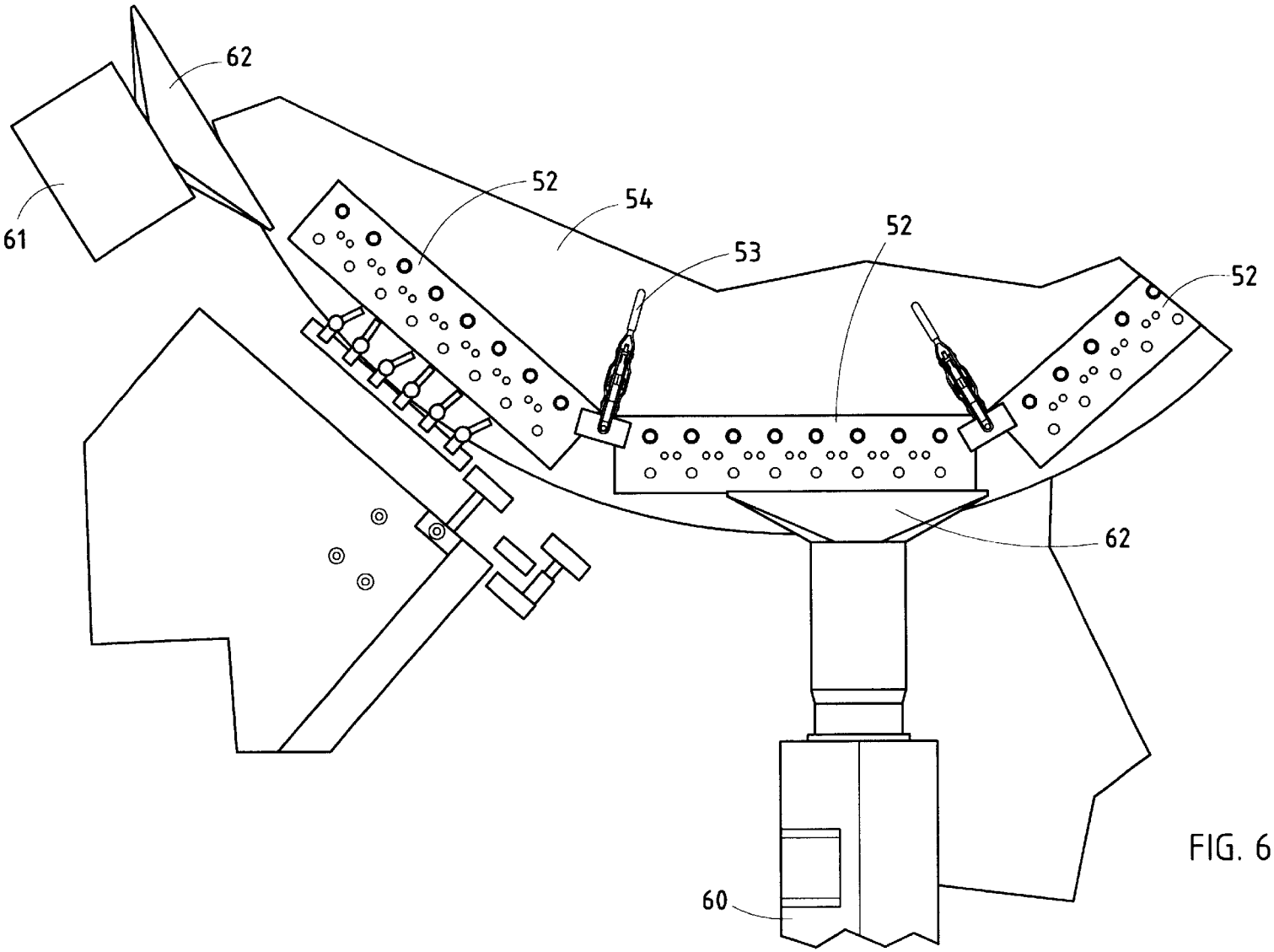
FIG. 6 is a top plan view of dryers and turntable of the printing station of apparatus shown in FIG. 1.

Adjacent turntable 54 are two drying units 60 and 61 (see FIG. 6), each having an expanded end 62 that is adjacent to the outer edge of turntable 54. Product fixtures 52 are positioned near the outer edge of turntable 54. Thus, once the item which sits in product fixture 52 is inked, the turntable is rotated so that the items are adjacent the dryer such that the ink may be dried.

Figure 7:
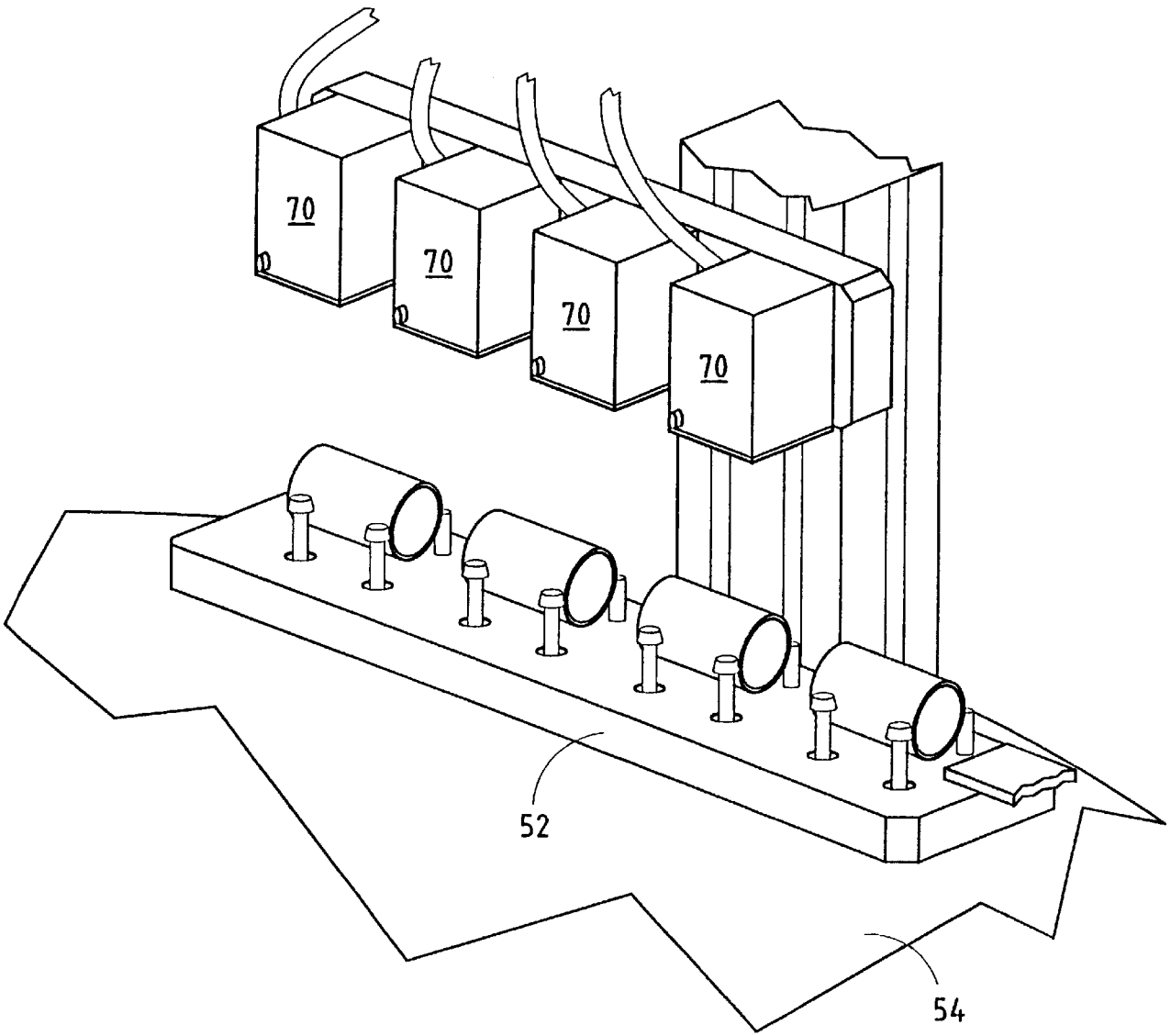
FIG. 7 is a perspective view of logo scanners of the printing station of the apparatus shown in FIG. 1.

FIG. 7 shows the bar code scanners 70 that scan the inked bar code to verify that the bar code, or other marking, on each item is acceptable. Scanners 70 each scan one item on product fixture 52 and send a signal electronically to a PLC of whether the printed bar codes passed the verification scanning test or not. If the items do not pass the verification test, the turntable 54 bypasses the curing tunnel 18 and progresses to the rejector, as described below.

Figure 8:
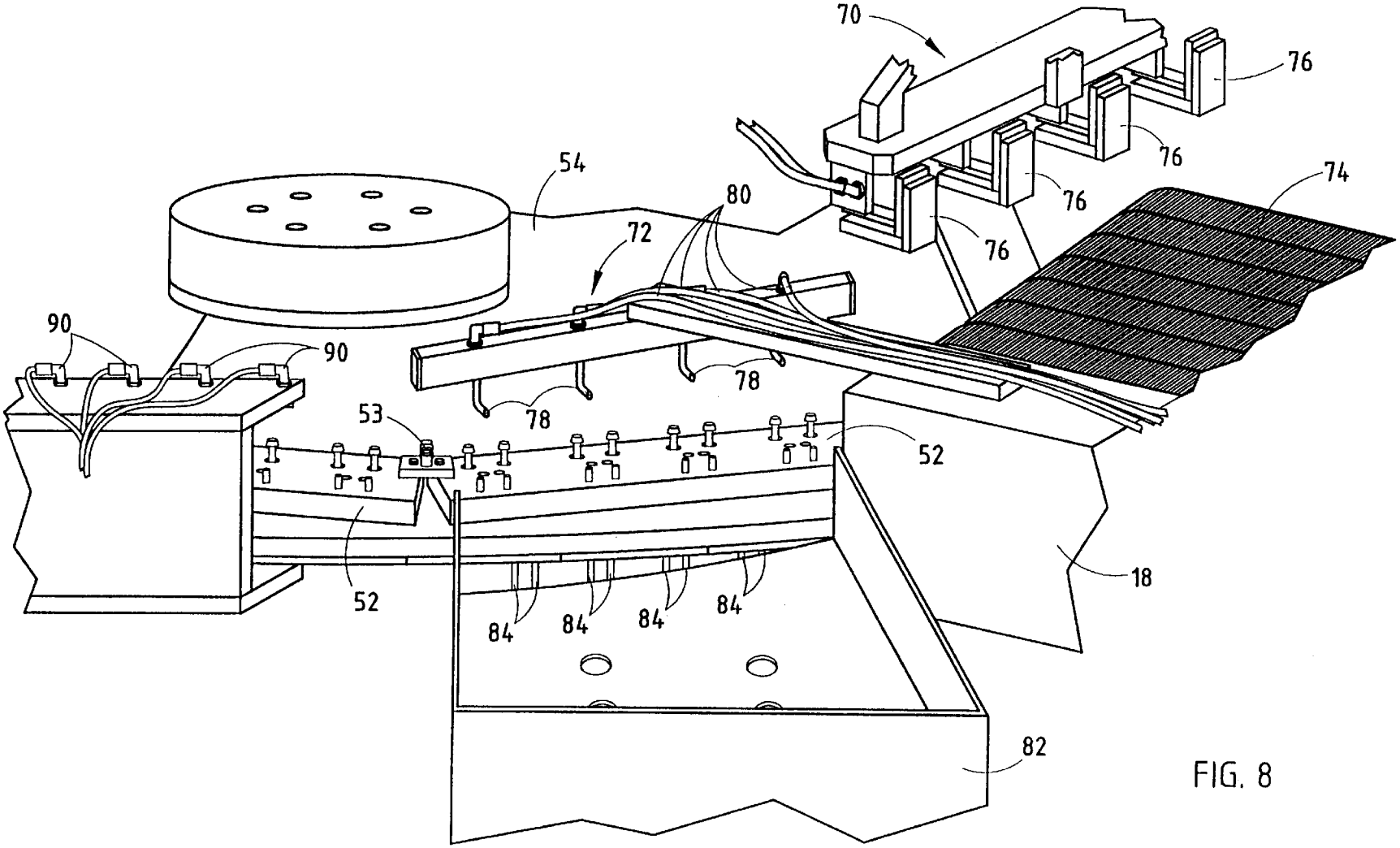
FIG. 8 is a partial perspective view of a curing tunnel and reject portion of the printing station of the apparatus shown in FIG. 1.
Figure 8A:
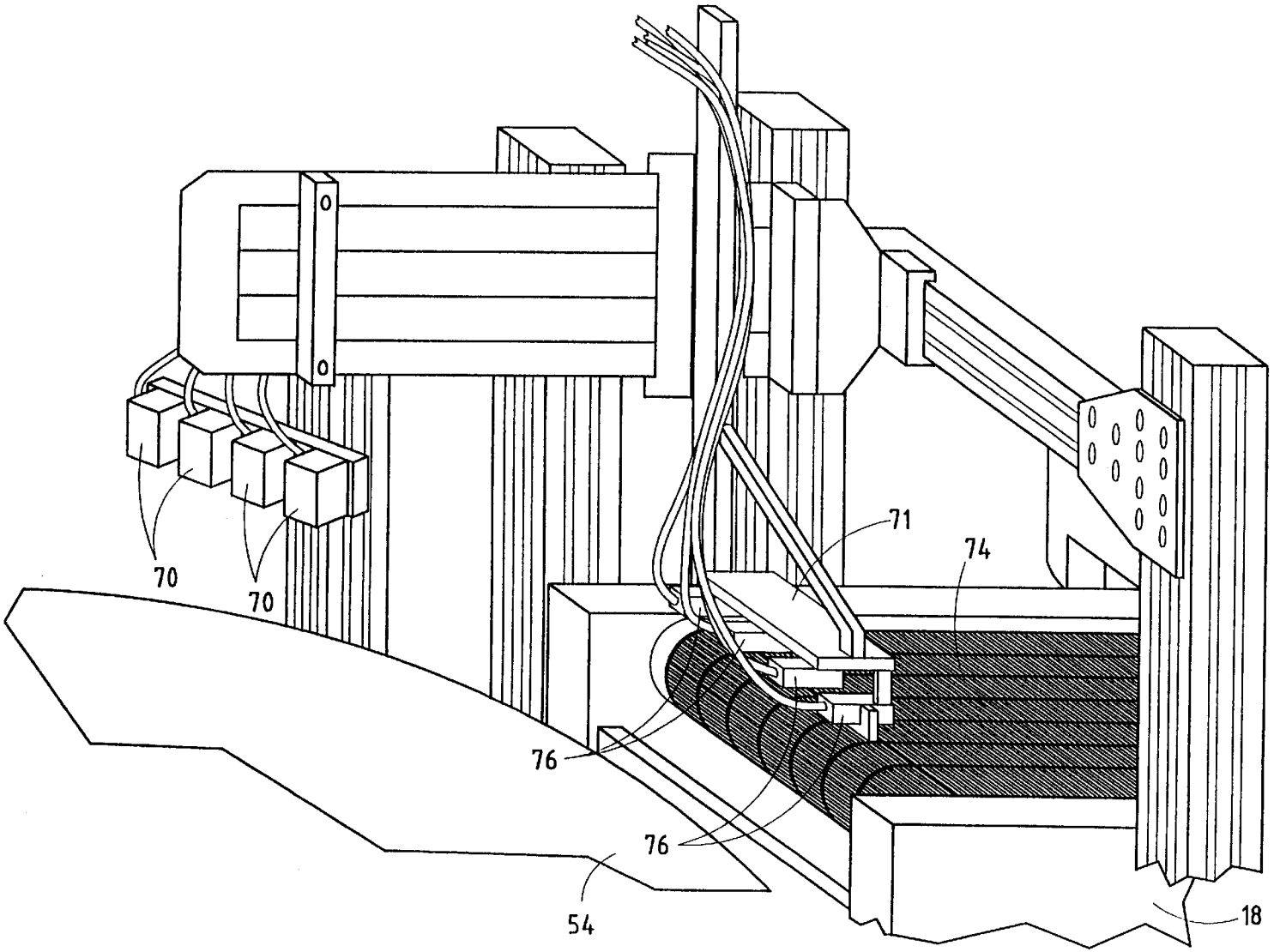
FIG. 8*a* is a partial perspective view of the curing tunnel and pick-and-place unit of the printing station of the apparatus shown in FIG. 1.

Directionally clockwise (looking from above turntable 54) to the verification scanners 70 is curing tunnel 18. FIG. 8 shows the positional relationship of turntable 54 to curing tunnel 18, and further shows a pick-and-place unit 71 and rejector 72 part of the system. The pneumatic pick-and-place unit 71 is used to off load the acceptable parts onto a conveyor 74 that leads to in curing tunnel 18. Pick-and-place unit 71 includes four robotic grippers 76 that pick the items out of a product fixture 52 and place the items on the curing tunnel conveyor 74 (see FIG. 8*a*).

Rejector 2 includes four air-assisted reject blow off units 78 (FIG. 8). The air-assisted blow off units 78 are operated by four air lines 80 that each provide a stream of air to be forced against the item to dislodge the item from product fixture 52 and into a reject part bin 82. Rejector 72 also includes reject eject pins 84, which lift the items vertically up off of the product fixture 52. Eject pins 84 are also air actuated. The system also includes four through beam part detector sensors 90 for detecting that the fixture is empty to ensure that no product remains on the product fixture 52 as the dial is turned and the next cycle is started.

Figure 9:
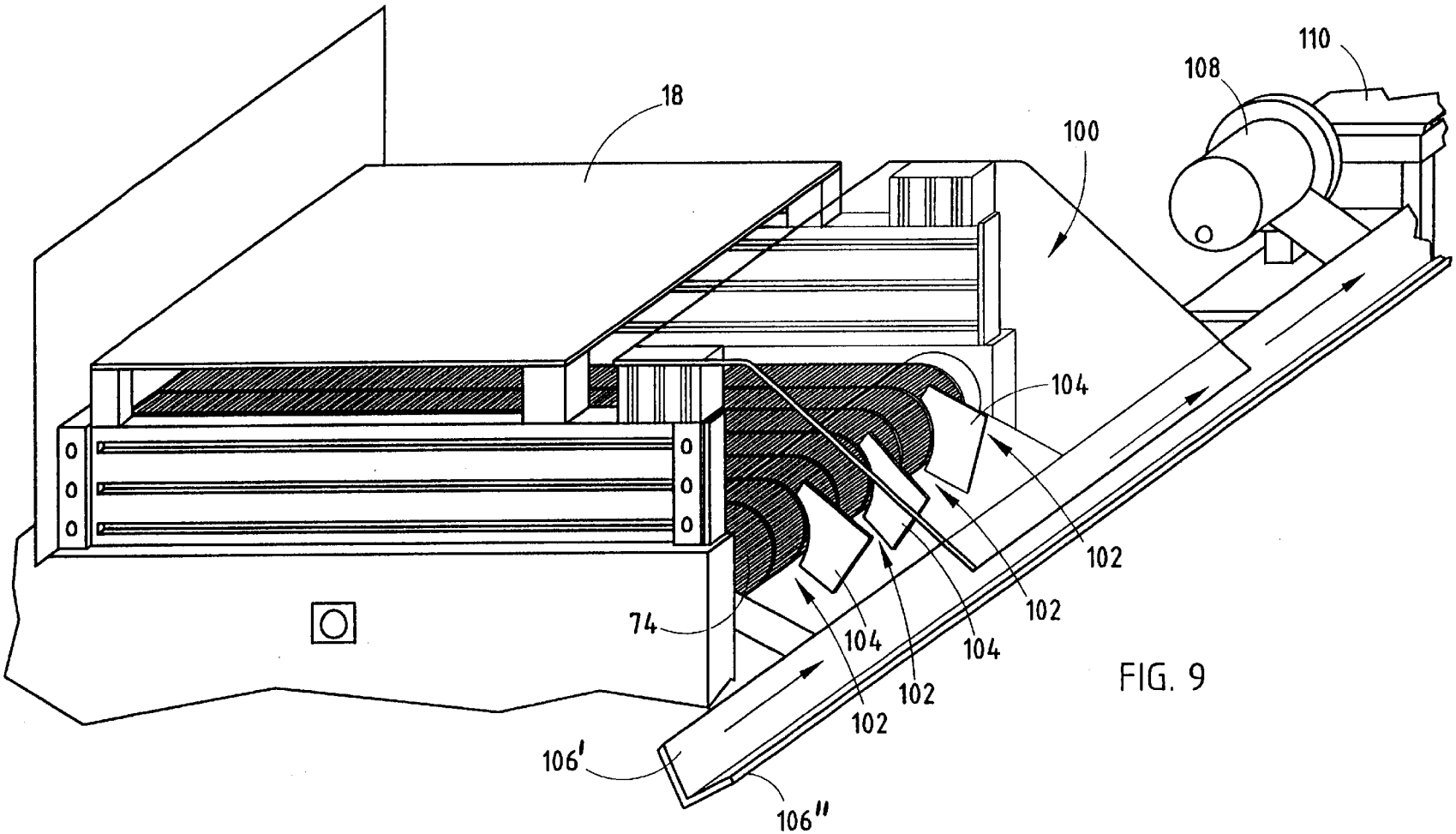
FIG. 9 is a partial perspective view of the curing tunnel and an angled conveyor of the apparatus shown in FIG. 1.
Figure 10:
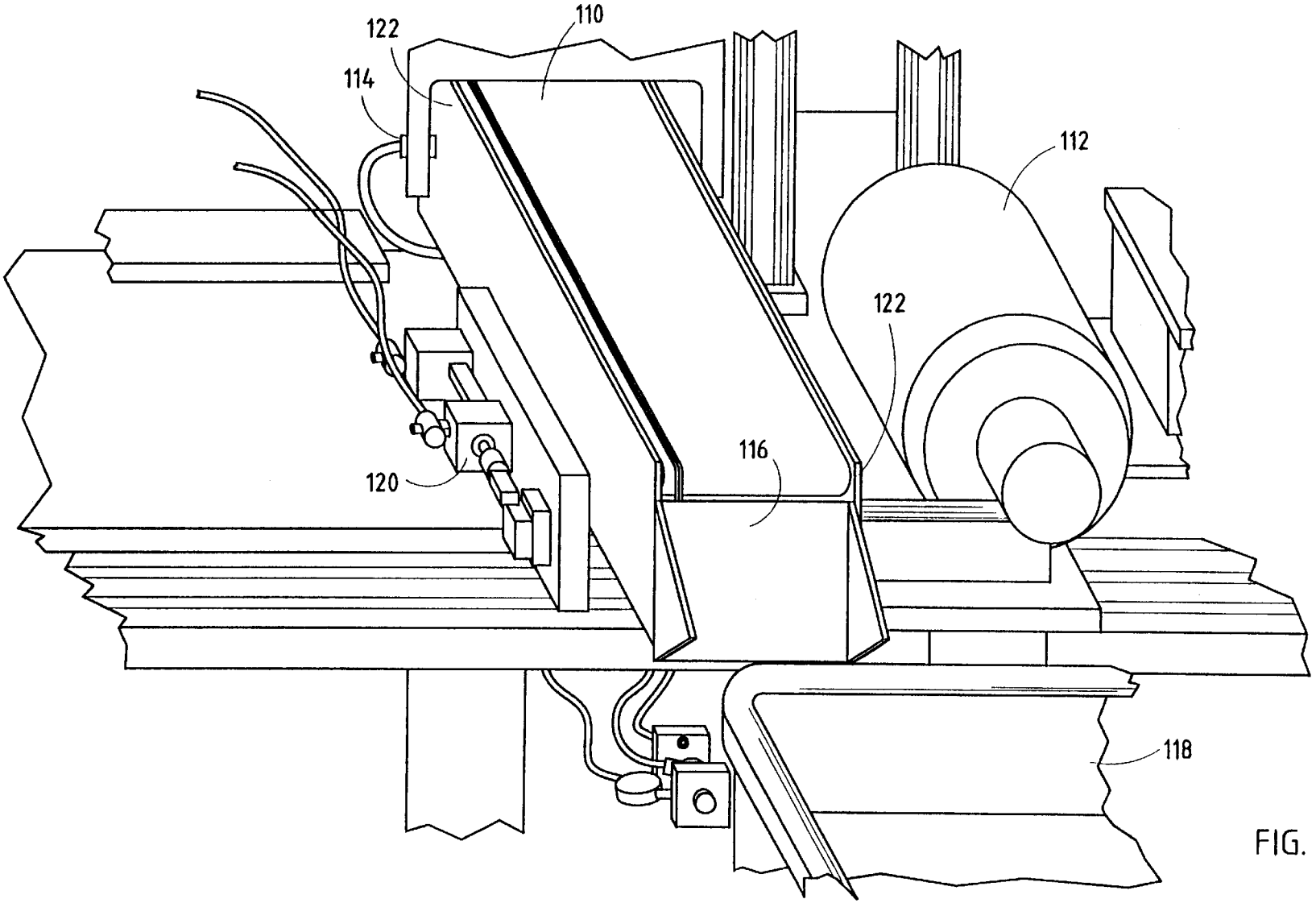
FIG. 10 is a perspective view of a conveyor and part sensor of the apparatus shown in FIG. 1.

Curing tunnel conveyor 82 is preferably made of metal cleat/mesh to minimize part rolling and preferably travels at 74 inches per minute through the curing tunnel. Curing tunnel 18 is preferably a confectionery oven, which is used to cure the ink onto the parts at a temperature of 450° F. for one minute. Another view of the curing tunnel 18 and its exit 100 are shown in FIG. 9. At exit 100 are a plurality of passageways 102 which are defined by metal walls 104. Directly below exit 100 is a conveyor 106, which is driven by an electric DC drive motor 108. Conveyor 106 has two separate conveyor belts 106' and 106" at an angle, preferably both 45° with respect to horizontal and therefore 90° with respect to each other in a "V" shape. At the end of conveyor 106, and slightly below conveyor 106, is another conveyor 110 which has a horizontal orientation. As seen in FIG. 10, conveyor 110 is actuated by an electric DC drive motor 112. Adjacent conveyor 110 is a part-detect-through-beam sensor 114, which is used for counting parts that pass on conveyor 110. At the end of conveyor 110 is a part hold back chute 116, which is shown in FIG. 10 in the "fill" position, thus allowing parts to drop into a box 118. Part hold back chute 116 is actuated by a pneumatic actuator 120 that, when the box count is reached, sensor 114 triggers a PLC that rotates part hold back chute 116 upwardly to a vertical position to hold back parts on the conveyor 110 until the full box 118 can be moved forward and an empty box is positioned in front of conveyor 110. Conveyor 110 also includes railing guides 122 to keep the items from falling off of conveyor 110.

In operation, the items to be marked are dumped in bulk into the bulk product tilt station 12, which channels the items into infeed hopper 14. From the infeed hopper, the items are conveyed to feeder 15 by conveyor 22, where the items are channeled through swivel chute 24 into bowl feeders 26 and 28. From bowl feeders 26 and 28, the items are motivated into the infeed conveyors 32–35, one at a time. Stack stoppers 3841 prevent jamming by controlling the number of items that load into infeed conveyors 32–35 at a given time. The individual items are fed along infeed conveyors 32–35 to the printing station 16. Once at the printing station 16, the items are lifted from the conveyor by the grippers 56 of the servo-controlled robot 50, which places and orients the items onto one of the product fixtures 52 on turntable 54. The items are placed in product fixture 52 and oriented by gripper and rotator 56. Hold down clamps 58 are depressed to insure that the fixtures remain secure on turntable 54.

Once secured in product fixture 52, the items are rotated on turntable 54 to the first inking station 64. The ink cups 132, 134 are moved to supply ink to receptacles 135 and the pads 66 are pressed downwardly thereon to lift the ink from the receptacles. A first color, preferably white when marking a bar code, is applied to the item by pressing the four pads 66 onto the four items held in fixture 52. Once the first color is applied, turntable 54 is then rotated in a clockwise direction so that the item, still in product fixture 52, is adjacent to first drying unit 60. Drying unit 60 is activated, thereby drying the first inked color on the item. Once this step is completed, turntable 54 is again rotated in a clockwise direction so that the item is moved to the second inking station 65. A second color, preferably black when a bar code is being marked on the item, is applied over the first ink color in the same manner as described above for the first color. Once the second color is applied, turntable 54 is again rotated so that the item is adjacent the second drying unit 61 where the second coat of ink is dried.

After the drying of the second coat of ink, turntable 54 is again rotated to motivate the item to the scanners 70. Scanners 70 scan the inked bar codes, or other such markings, on the items for verification that the markings are readable. If the markings are acceptable, the turntable 54 is rotated so the items are adjacent conveyor 74 and the items are lifted by the pick and place unit 71, which grips each item, and places the item on conveyor 74 of the curing tunnel 18. If one or more items is found to be unacceptable by any of the scanners 70, turntable 54 is rotated, motivating the items to the rejector 72. The eject pins 78 are actuated, which lift the rejected items up off of the product fixture 52, and the air-assisted blow off units 84 are actuated by air lines 80. The air assisted blow off units 78 blow the items off of the product fixture 52 and into the reject part bin 82.

The items that are not rejected are conveyed along conveyor 74 through curing tunnel 18, where the items are subjected to an oven-like atmosphere at 450° F. Once the items reach the curing tunnel exit 100, the items fall by gravitational forces through passageways 102 past metal walls 104 and onto conveyor 106, where the items are conveyed in the direction of travel indicated by the arrows in FIG. 8. At the end of conveyor 106, the items fall onto conveyor 110. The items are counted by the detect-through beam sensor 114. The items are conveyed to the end of conveyor 110, where they drop off past part-hold-back-chute 116 into box 118. After the desired number of items pass detect-through beam sensor 114, which indicates that box 118 is full, pneumatic actuator 120 raises part-hold-back-chute 116 to a vertical position, thus disallowing the items to drop off into box 118. Box 118 is then removed, and replaced with an empty box. Part hold back chute 116 is then lowered again by disengagement of pneumatic actuator 120. The items are then boxed or otherwise packaged at fill station 20. The above-described system provides a reliable marking system, especially with regard to UPC bar codes, and allows differently-shaped items to be marked using the same system. Furthermore, it provides a system whereby items made of compositions that have been traditionally very difficult to mark with ink, particularly wrought copper items such as pipe fittings, can be marked with ink.

The above description is considered that of the preferred embodiment only. Modifications of the invention will occur to those skilled in the art and to those who make or use the invention. Therefore, it is understood that the embodiment shown in the drawings and described above is merely for illustrative purposes and not intended to limit the scope of the invention, which is defined by the following claims as interpreted according to the principles of patent law, including the doctrine of equivalents.

The invention claimed is:

1. A method of marking an item comprising the steps of:

(a) providing a copper pipe fitting having an area thereon to be printed;

(b) orienting said copper pipe fitting in a position so that ink may be printed on the said desired area of said item;

(c) motivating said copper pipe fitting to a printing station;

(d) printing an ink of a first color on said copper pipe fitting while said copper pipe fitting is at said printing station;

(e) drying said ink of a first color while on said printing station; and (f) curing said ink by providing heat to said ink.

2. An apparatus for marking differently shaped items comprising:

a printing station comprising:

a first inking printer for transferring an ink of a first color to an item;

a first dryer for drying said ink of a first color on the item to be marked and adjacent said first inking printer;

a second inking printer for transferring an ink of a second color to the item and adjacent said first dryer, wherein said printing station is adapted so that said ink of a first color and said ink of a second color can be combined to form a bar code; and a second dryer for drying said ink of a second color on the item to be marked and adjacent said second inking printer;

a curing tunnel that provides heat to the item to cure both said ink of a first color and said ink of a second color to provide added adherence of said inks to the item; and a verification system for verifying that a bar code is useable.

3. An apparatus for marking differently shaped items comprising:

a printing station comprising:

a first inking printer for transferring an ink of a first color to an item;

a first dryer for drying said ink of a first color on the item to be marked and adjacent said first inking printer;

a second inking printer for transferring an ink of a second color to the item and adjacent said first dryer, wherein said printing station is adapted so that said ink of a first color and said ink of a second color can be combined to form a bar code; and a second dryer for drying said ink of a second color on the item to be marked and adjacent said second inking printer;

a curing tunnel that provides heat to the item to cure both said ink of a first color and said ink of a second color to provide added adherence of said inks to the item;

a verification system for verifying that a bar code is useable; and a rejecter for unloading items without an acceptable bar code.

* * * * *

UNITED STATES PATENT AND TRADEMARK OFFICE

CERTIFICATE OF CORRECTION

PATENT NO. : 6,584,894 B1
DATED : July 1, 2003
INVENTOR(S) : Christopher W. Mason It is certified that error appears in the above-identified patent and that said Letters Patent is hereby corrected as shown below:

Column 2,
Line 19, "cliche" should be -- cliché --

Column 3,
Line 48, "cliche" should be -- cliché --

Column 5,
Line 6, "3841" should be -- 38-41 --

Signed and Sealed this

Fourteenth Day of October, 2003

JAMES E. ROGAN
*Director of the United States Patent and Trademark Office*